US009021933B2

(12) United States Patent
Guha et al.

(10) Patent No.: US 9,021,933 B2
(45) Date of Patent: May 5, 2015

(54) VEHICLE CAPABLE OF DISSIPATING EXPLOSION FORCE AND ENERGY

(71) Applicants: Sujoy Kumar Guha, New Delhi (IN); Sudershan Neogi, Kharagphur (IN); Rajinder Sachdev, New Delhi (IN)

(72) Inventors: Sujoy Kumar Guha, New Delhi (IN); Sudershan Neogi, Kharagphur (IN); Rajinder Sachdev, New Delhi (IN)

(73) Assignee: Sujoy Kumar Guha, New Delhi (IN)

( * ) Notice: Subject to any disclaimer, the term of this patent is extended or adjusted under 35 U.S.C. 154(b) by 97 days.

(21) Appl. No.: 13/801,292

(22) Filed: Mar. 13, 2013

(65) Prior Publication Data

US 2014/0157976 A1 Jun. 12, 2014

Related U.S. Application Data

(62) Division of application No. 13/390,066, filed as application No. PCT/IN2010/000526 on Aug. 9, 2010, now Pat. No. 8,490,537.

(30) Foreign Application Priority Data

Aug. 11, 2009 (IN) ..... 1668/DEL/2009

(51) Int. Cl.
*F41H 7/02* (2006.01)
*F41H 7/04* (2006.01)
*F42D 5/045* (2006.01)

(52) U.S. Cl.
CPC ..... *F41H 7/044* (2013.01); *F41H 7/02* (2013.01); *F41H 7/042* (2013.01); *F42D 5/045* (2013.01)

(58) Field of Classification Search
CPC ..... F41H 7/042; F41H 7/04; F41H 7/044; F41H 7/02; F41H 5/023; F41H 7/048; F41H 5/0492; F41H 7/00; F41H 5/0442
USPC ..... 89/36.07–36.09; 296/187.03–187.13
See application file for complete search history.

(56) References Cited

U.S. PATENT DOCUMENTS 3,765,299 A * 10/1973 Pagano et al. ..... 89/36.08
3,806,184 A * 4/1974 Dean ..... 296/35.1

(Continued)

FOREIGN PATENT DOCUMENTS

WO 2010123606 A1 10/2010
WO 2011018797 A1 2/2011

OTHER PUBLICATIONS

Foreign communication from priority application—International Search Report and Written Opinion, PCT/IN2010/000526, Jan. 19, 2011, 13 pages.

(Continued)

*Primary Examiner* — Samir Abdosh
(74) *Attorney, Agent, or Firm* — Conley Rose, P.C.; Rodney B. Carroll

(57) ABSTRACT

A vehicle capable of dissipating explosion force and energy caused due to explosion of an explosive including but not limiting to mine and/or grenade under the vehicle, below the wheels, and/or on side of the vehicle with minimal effect on the personnel and material inside the vehicle, and thereby, capable of providing safety and stability to the personnel and material inside the vehicle even if vehicle is made from armor of low thickness is provided, wherein blast air force and energy is directed through one or more passages (7, 8, 9) running from one side of the vehicle to opposite side of the vehicle in a manner that blast air force and energy generated on explosion dissipates from side of the explosion through said passages to another side of the vehicle. In one embodiment, the vehicle further comprises a periscope like structure (21) and corrugated sheet (31, 32, 33).

18 Claims, 8 Drawing Sheets

(56) References Cited

U.S. PATENT DOCUMENTS

| | | | | |
|---|---|---|---|---|
| 4,664,967 | A | 5/1987 | Tasdemiroglu | |
| 4,965,138 | A * | 10/1990 | Gonzalez | 428/593 |
| 5,149,910 | A * | 9/1992 | McKee | 89/36.02 |
| 5,533,781 | A | 7/1996 | Williams | |
| 5,866,839 | A | 2/1999 | Ohayon | |
| 6,096,403 | A * | 8/2000 | Wycech | 428/122 |
| 6,139,082 | A * | 10/2000 | Davis et al. | 296/72 |
| 6,658,984 | B2 | 12/2003 | Zonak | |
| 6,779,431 | B2 | 8/2004 | Honlinger | |
| 6,851,246 | B2 * | 2/2005 | Laurent | 52/843 |
| 6,873,920 | B2 * | 3/2005 | Dunleavy et al. | 702/42 |
| 6,905,138 | B2 * | 6/2005 | Borroni-Bird et al. | 280/783 |
| 7,255,034 | B2 | 8/2007 | Strassgurtl et al. | |
| 7,357,062 | B2 | 4/2008 | Joynt | |
| 7,488,022 | B2 * | 2/2009 | Belwafa et al. | 296/29 |
| 7,695,053 | B1 | 4/2010 | Boczek et al. | |
| 7,828,388 | B2 * | 11/2010 | Thomas | 297/411.21 |
| 7,908,959 | B2 * | 3/2011 | Pavon | 89/36.17 |
| 7,914,069 | B2 | 3/2011 | Barbe et al. | |
| 7,997,182 | B1 * | 8/2011 | Cox | 89/36.09 |
| 8,205,703 | B2 | 6/2012 | Halliday | |
| 8,246,106 | B2 | 8/2012 | Boczek et al. | |
| 8,430,196 | B2 | 4/2013 | Halliday | |
| 2008/0111396 | A1 * | 5/2008 | Barbe et al. | 296/187.08 |
| 2010/0071539 | A1 * | 3/2010 | Boczek et al. | 89/36.08 |
| 2010/0163330 | A1 * | 7/2010 | Halliday | 180/295 |
| 2010/0206158 | A1 * | 8/2010 | Neethling | 89/36.02 |
| 2011/0148147 | A1 * | 6/2011 | Tunis et al. | 296/187.07 |
| 2011/0197744 | A1 * | 8/2011 | Cox | 89/36.02 |
| 2012/0049570 | A1 * | 3/2012 | Aizik | 296/187.08 |
| 2012/0111181 | A1 * | 5/2012 | Brill et al. | 89/36.08 |
| 2012/0137867 | A1 | 6/2012 | Guha et al. | |
| 2012/0152101 | A1 * | 6/2012 | Engleman et al. | 89/36.08 |
| 2012/0174766 | A1 * | 7/2012 | Boczek et al. | 89/36.08 |
| 2012/0174767 | A1 * | 7/2012 | Naroditsky et al. | 89/36.08 |
| 2012/0181100 | A1 * | 7/2012 | Halliday | 180/291 |
| 2012/0186428 | A1 * | 7/2012 | Peer et al. | 89/36.02 |
| 2012/0193940 | A1 * | 8/2012 | Tunis et al. | 296/187.07 |

OTHER PUBLICATIONS

Foreign communication from priority application—International Preliminary Report on Patentability, PCT/IN2010/000526, Feb. 14, 2012, 8 pages.

Office Action dated Sep. 6, 2012, 15 pages, U.S. Appl. No. 13/390,066, filed Feb. 10, 2012.

Office Action dated Dec. 11, 2012, 8 pages, U.S. Appl. No. 13/390,066, filed Feb. 10, 2012.

Notice of Allowance dated Mar. 25, 2013, 8 pages, U.S. Appl. No. 13/390,066, filed Feb. 10, 2012.

* cited by examiner

VEHICLE CAPABLE OF DISSIPATING EXPLOSION FORCE AND ENERGY

CROSS-REFERENCE TO RELATED APPLICATIONS

This application is a divisional of and claims priority to U.S. patent application Ser. No. 13/390,066 filed on Feb. 10, 2012 and entitled "A Vehicle Capable of Dissipating Explosion Force and Energy," which is a filing under 35 U.S.C. 371 of International Application No. PCT/IN2010/000526 filed Aug. 9, 2010, entitled "A Vehicle Capable of Dissipating Explosion Force and Energy," claiming priority of Indian Patent Application No. 1668/DEL/2009 filed Aug. 11, 2009, which applications are incorporated by reference herein in their entirety.

FIELD OF THE INVENTION

The present invention relates to a vehicle capable of dissipating explosion force and energy.

Particularly, it relates to a vehicle which is capable of dissipating explosion force and energy on blast under the vehicle, below the wheels, and/or on side of the vehicle.

More particularly, it relates to a vehicle which is capable of dissipating explosion force and energy caused due to explosion of an explosive including but not limiting to mine and/or grenade under the vehicle, below the wheels, and/or on side of the vehicle, and is capable of providing safety and stability to the personnel and material in the vehicle.

Even more particularly, it relates to a vehicle which is capable of dissipating explosion force and energy caused due to explosion of an explosive including but not limiting to mine and/or grenade under the vehicle, below the wheels, and/or on side of the vehicle with minimal effect on the personnel and material inside the vehicle, and thereby, is capable of providing safety and stability to the personnel and material inside the vehicle even if vehicle is made from armor of low thickness.

BACKGROUND OF THE INVENTION

The vehicles are used in the mass movement of personnel including but not limiting to security personnel, and materials including but not limiting to explosives. With the increasing incidence of terrorism the world over such vehicles are often targeted by terrorists by exploding mines, grenades, bombs etc. The explosion generates explosion force and energy, which may also be referred to as blast air force and energy because any explosion results in flow of air in such a manner and to such an extent that it cannot only topple the vehicle but can also damage the vehicle or part thereof. An explosion occurring under the vehicle and/or below the wheels of the vehicle and/or on side of the vehicle, depending upon the force and energy generated, can topple the vehicle and/or damage the vehicle or part thereof. The toppling of the vehicle, depending upon the blast force and energy generated, can destabilize the vehicle, and hence, can cause injury to the passengers and damage structure of the vehicle.

U.S. Pat. No. 4,664,967 provides add-on armor plate, ballistic spall liner, which is installable on the inner surface of the unprotected vehicle. As per the patent, the liner is capable of providing protection to the vehicle occupants and internal equipment from risk of injury or damage which can be caused due to flying metallic debris on penetration of a projectile into wall of the vehicle.

The main problem of an arrangement provided by U.S.'967 is that it cannot protect toppling of and damage to the vehicle if blast takes place under the vehicle and/or under the wheels and/or on sides of the vehicle, because the liner is effective to dissipate projectile force only and not effective to dissipate explosion force and energy caused due to blast under the vehicle and/or under the wheels and/or on sides of the vehicle. The plate liner of U.S.'967 cannot overcome damaging effects of blast air force and energy which can cause impact flow of air to such an extent that the vehicle not only topples but also gets damaged, and thereby, causes injury and damage to the occupants and internal equipment.

Another problem of an arrangement provided by U.S.'967 is that it requires specially designed and produced plate liner which has to comprise multiple layers of various different materials including a delaminating base layer comprised of at least three plies of high tensile strength fabric, first continuous facing layer of martensite sheet steel, a delaminating intermediate layer comprised of at least three plies of a high tensile strength fabric, a second continuous facing layer of martensite sheet steel, an elongating outer layer comprised of at least three plies of high tensile strength fabric, wherein each of the layers has to be bonded to adjacent layers so as to form a rigid laminated armor plate liner, which will not only increase weight of the vehicle, but will also increase cost of manufacturing the vehicle. It is obviously known that increase in weight of the vehicle results in greater difficulty when it has to climb on the hilly area and overall poor efficiency. Further, increase in weight impedes maneuvering of the vehicle, and thereby, makes the vehicle an easier target for attack.

U.S. Pat. No. 5,533,781 provides a system wherein a fibrous material is bonded to the upper surface of the floor and a ballistic panel/blast shield is disposed below the floor and is spaced from the lower surface of the floor in such a manner that it creates an air gap. As per this patent, the panel, air gap, resilient material and flooring is capable of providing resistance to blast pressure caused due to underneath blast.

The main problem of the system provided in U.S.'781 is that the air gap between ballistic panel/blast shield and lower surface of the floor is only capable of reducing blast pressure by causing bending of ballistic panel/blast shield towards the floor due to air gap formed therein.

Even system of U.S.'781 cannot substantially protect toppling of the vehicle if blast takes place under the vehicle.

Further, even system of U.S.'781 cannot protect toppling of and damage to the vehicle if blast takes place under the wheels and/or on sides of the vehicle, because the ballistic panel/blast shield of this patent is effective only to dissipate blast pressure caused due to underneath blast and not effective to dissipate explosion force and energy caused due to blast under the wheels and/or on sides of the vehicle. Therefore, the ballistic panel/blast shield cannot overcome damaging effects of blast air force and energy which can cause impact flow of air to such an extent that the vehicle not only topples but also gets damaged, and thereby, causes injury and damage to the personnel and internal material.

U.S. Pat. No. 5,866,839 provides an armor protection system by utilizing armor deflection technique for blocking armor piercing weapons, which is achieved by providing metal balls organized in a 'very' special pattern to generate blocking force against armor piercing weapons.

The main problem of system provided by U.S.'839 is that the armor protection system requires arrangement of metal balls in a 'very' special pattern, which is possible by a highly skilled person.

Another problem of system provided by U.S.'839 is that metal balls are either of titanium or of magnesium, which are very expensive materials, and hence, the cost of system is very high.

Further, problem of system provided by U.S.'839 is that arrangement of balls is required to be provided all around the tank or fighting vehicle for maximum coverage, which means the part of the vehicle not provided with this arrangement is prone to damage.

Still another problem of system provided by U.S.'839 is that the special arrangement of metal balls is only capable of deflecting the kinetic energy of the weapons and to stop the weapons which touch the vehicle and is intended to pierce the vehicle, but is not capable of protecting the vehicle from toppling and damage if blast takes place under the vehicle and/or under the wheels and/or on sides of the vehicle, because special arrangement of metal balls is not effective to dissipate explosion force and energy caused due to blast under the vehicle and/or wheels and/or on sides of the vehicle.

Therefore, even special arrangement of metal balls of U.S.'839 cannot overcome damaging and toppling effects of blast air force and energy which can cause impact flow of air to such an extent that the vehicle not only topples but also gets damaged, and thereby, causes injury and damage to the crew and materials therein.

An attempt to avoid damage to the vehicle due to blast under the vehicle has been made by U.S. Pat. No. 6,658,984, by providing anti-mine concave floor plate, which is provided in such a manner that a sufficient ground clearance and clear distance between the concave floor plate and spring bars or support arms mounted above the floor plate is available. As per this patent, the damage to vehicle is avoided due to clear distance between the concave floor plate and the built-in parts of the vehicle which in the event of a mine detonation beneath the vehicle allows the concave floor plate to form a dynamic bulge.

The main problem of system provided by U.S.'984 is that it cannot substantially protect toppling of and damage to the vehicle even if blast takes place under the vehicle, because the clear distance between concave floor plate and floor of the vehicle is limited, and therefore, can only protect the vehicle from blast of limited intensity.

Further, even system of U.S.'984 cannot protect toppling of and damage to the vehicle if blast takes place under the wheels and/or on sides of the vehicle, because concave floor plate of this patent is effective only to dissipate blast pressure caused due to underneath blast and not effective to dissipate explosion force and energy caused due to blast under the wheels and/or on sides of the vehicle.

Therefore, the concave floor plate of U.S.'984 cannot overcome damaging effects of blast air force and energy which can cause impact flow of air to such an extent that the vehicle not only topples but also gets damaged, and thereby, causes injury and damage to the personnel and internal material.

U.S. Pat. No. 6,779,431 also attempts to avoid damage to the vehicle due to blast under the vehicle by providing an arrangement consisting of a foot floor comprising of rigid self-supporting material, wherein the foot floor is arranged above the vehicle inner floor and is supported thereon by air spring bags solely at its edge regions and is connected to vehicle floor with the help of flexible connecting elements in the form of straps and bands in such a manner that it forms a spacing with the vehicle inner floor. As per this patent, no rigid connection exists between the foot floor and sidewalls of the vehicle, and between the foot floor and inner floor of the vehicle. The transmission of the impulse wave, caused due to mine blast, is prevented from vehicle inner floor onto foot floor by the flexible connecting elements. The air spring bags support foot floor onto vehicle inner floor without providing any rigid connection there-between, and capability to support foot floor depends upon air pressure in air spring bags. In absence of rigid connection between foot floor and sidewalls of the vehicle, and between foot floor and inner floor of the vehicle, the balancing of foot floor is achieved by flexible connecting elements—the straps or bands.

Accordingly, it is understood that as per U.S.'431 the capability to withstand blast force and energy on account of blast under the vehicle will depend upon the air pressure in the air spring bags and strength of flexible connecting elements. Therefore, such an arrangement will not be capable of preventing damage to the vehicle when air pressure of air spring bags is leaked and/or when flexible connecting elements gets weak over the period of time.

Therefore, the main problem of system provided by U.S.'431 is that it also cannot protect toppling of and damage to the vehicle even if blast takes place under the vehicle.

Further, even system of U.S.'431 cannot protect toppling of and damage to the vehicle if blast takes place under the wheels and/or on sides of the vehicle, because no solution to these problems has been proposed in this patent.

U.S. Pat. No. 7,255,034 also makes an attempt to avoid damage to the vehicle due to blast under the vehicle by providing an inwardly bend bottom plate on the underside of the vehicle body in such a manner that a spacing is formed between the bottom plate and floorboard. As per this patent, the damage to the vehicle is avoided due to capability of the bottom plate to form dynamic inward buckling in a deformation space between the bottom plate and the floorboard without causing injury to the occupants of the vehicle.

Accordingly, it is once again understood that as per U.S.'034 damage to vehicle can be avoided only to the extent to which dynamic inward buckling can take place in the bottom plate, and hence, will depend upon the spacing between the bottom plate and floorboard. As extent of dynamic inward buckling, and spacing between the bottom plate and floorboard are limited, the capability of such an arrangement to avoid the damage, therefore, will also be limited.

Therefore, even arrangement provided in U.S.'034 cannot substantially protect toppling of and damage to the vehicle even if blast takes place under the vehicle.

Further, even system of U.S.'034 cannot protect toppling of and damage to the vehicle if blast takes place under the wheels and/or on sides of the vehicle, because bottom plate of this patent is restrictively effective only to dissipate effect of underneath blast and not effective to dissipate explosion force and energy caused due to blast under the wheels and/or on sides of the vehicle.

Therefore, the bottom plate of U.S.'034 also cannot overcome damaging effects of blast air force and energy which can cause impact flow of air to such an extent that the vehicle not only topples but also gets damaged, and thereby, causes injury and damage to the personnel and internal material.

U.S. Pat. No. 7,357,062 also makes an attempt to avoid damage to the vehicle due to blast under the vehicle by forming specially designed substantially V-shaped bottom portion of the vehicle having particular apex, tip and angle. In accordance with this patent, the effect of blast is absorbed by V-shaped structure of bottom portion and a metal energy-absorbing member which extends longitudinally along and is affixed to the interior of the apex of the V-shaped bottom portion, and the metal energy-absorbing member is a metal pipe, which is provided for diverting the penetrating material. Additionally, there is provided a sheet armor comprised of rigid polymer/fiber composite adjacent to the interior surface of the body in such a manner that it forms a gap from the interior surface.

Accordingly, it is understood that as per U.S.'062 capability of vehicle to avoid damage will depend upon design of V-shaped structure of bottom portion and obviously distance of its tip from the road and capability of metal energy-absorbing member. Additionally, on the capability of the sheet armor to withstand the blast force and its distance from interior surface of body, which upon intense blast may form dynamic inward buckling in the space between sheet armor and interior surface of the body. Further, the sheet armor being rigid composite and being provided adjacent to the interior surface of the body while forming a gap therefrom can neither stop and divert the flying debris and shrapnel entering or hitting the walls of vehicle, nor can dissipate the blast energy. Further, as distance of tip of V-shaped bottom portion from the road, capability of metal energy-absorbing member, capability of the sheet armor to withstand the blast force, distance of the sheet armor from interior surface of body are limited, the capability of such an arrangement to avoid the damage, therefore, will also be limited.

Therefore, even arrangement provided in U.S.'062 cannot substantially protect toppling of and damage to the vehicle even if blast takes place under the vehicle.

Further, even system of U.S.'062 cannot protect toppling of and damage to the vehicle if blast takes place under the wheels and/or on sides of the vehicle, because arrangement provided in U.S.'062 is restrictively effective only to dissipate effect of underneath blast and not effective to dissipate explosion force and energy caused due to blast under the wheels and/or on sides of the vehicle.

Therefore, even arrangement of U.S.'062 also cannot overcome damaging effects of blast air force and energy which can cause impact flow of air to such an extent that the vehicle not only topples but also gets damaged, and thereby, causes injury and damage to the personnel and internal material.

From the foregoing description, it is understood that none of the systems as known in the art is capable of dissipating explosion force and energy [may also be referred to as blast air force and energy] caused due to blast possibly at or around any point or angle of the vehicle, including blast under the vehicle and/or below the wheels, and/or on side of the vehicle, that's too without causing toppling and damage to the vehicle, and simultaneously providing safety and stability to the personnel and internal material even if vehicle is made from armor of low thickness.

Therefore, there is a need to provide a system for the vehicle which is capable of dissipating explosion force and energy [blast air force and energy] caused due to blast possibly at or around any point or angle of the vehicle, including blast under the vehicle and/or below the wheels, and/or on side of the vehicle, that's too without causing toppling and damage to the vehicle, and simultaneously providing safety and stability to the personnel and internal material even if vehicle is made from armor of low thickness.

SUMMARY OF THE INVENTION

The present invention, therefore, aims to solve problems of toppling of and damage to vehicle, and of injury to the personnel and damage of internal material therein on blast outside the vehicle, whether under the vehicle, below the wheels, and/or on side of the vehicle, by providing a system for the vehicle which renders the vehicle capable of dissipating explosion force and energy [blast air force and energy] caused due to blast possibly at or around any point or angle outside the vehicle even if the vehicle is made from walls having low thickness.

The main object of the present invention is to provide a system for the vehicle which will render the vehicle capable of dissipating explosion force and energy [blast air force and energy] caused due to blast possibly at or around any point or angle of the vehicle, including blast under the vehicle and/or below the wheels, and/or on side of the vehicle, that's too without causing toppling and damage to the vehicle, and simultaneously providing safety and stability to the personnel and internal material even if vehicle is made from armor of low thickness.

This is also an object of the present invention to provide a system for the vehicle which is capable of providing protection to the vehicle, and to occupants and internal equipment therein from risk of injury and/or damage which can be caused due to explosion of an explosive including but not limiting to mine and/or grenades, flying metallic debris, shrapnel caused due to explosion of a projectile which otherwise would have penetrated into walls of the vehicle.

This is also an object of the present invention to provide a system for the vehicle which is capable of not only stopping and diverting the flying debris and shrapnel entering or hitting the walls of vehicle, which otherwise would have penetrated into the walls of the vehicle, but is also capable of dissipating blast energy caused due to such flying debris and shrapnel.

This is also an object of the present invention to provide a system for the vehicle wherein walls of the vehicle are provided by sheet armor which is capable of dissipating the energy caused due to penetrating projectile, and flying debris caused from explosion of one or more of explosive materials comprising penetrating projectile, grenade, mines and like.

This is also an object of the present invention to provide a system for the vehicle wherein specially designed components of the prior art, like plate liner, floor plate, bottom plate, foot floor, flexible connecting elements, air spring bags, specially designed bottom portion are not required.

This is also an object of the present invention to provide a system for the vehicle wherein no heavy structural component is required which otherwise may render the vehicle heavier, and hence, may cause difficulty when it has to climb on the hilly area, and may also reduce overall efficiency of the vehicle, and therefore, vehicle of present invention is capable of overcoming problems of maneuvering it, and thereby, makes it less prone to target for attack.

This is also an object of the present invention to provide a system for the vehicle wherein no expensive component, for example, titanium balls or magnesium balls are required which otherwise may render the vehicle expensive, and hence, may make it unaffordable.

This is also an object of the present invention to provide a system for the vehicle wherein no special material is required all around the vehicle, but maximum coverage is still achievable by simpler constructional modifications of the vehicle.

This is also an object of the present invention to provide a system for the vehicle which is capable of deflecting the kinetic energy of the weapons meaning thereby is capable of stopping damage to the vehicle, occupants and internal material therein.

This is also an object of the present invention to provide a system for the vehicle wherein ground clearance of the vehicle is not adversely affected.

This is also an object of the present invention to provide a system for the vehicle which is capable of dissipating blast air force and energy wherein its such efficiency is not dependable upon any gap, distance between any components, and hence, is capable of protecting the vehicle from blast of high intensity.

This is also an object of the present invention to provide a system for the vehicle wherein its capability of dissipating blast air force and energy is not dependent upon any air pressure, and hence, its capability will not get weaker over the period of time.

Other objects and advantages of the present invention will become more apparent from the following description when it is read in conjunction with the accompanying figures, which are incorporated only to illustrate the invention and are not intended to limit scope of present invention. Further, the accompanying figures, are not to scale.

DETAILED DESCRIPTION OF THE INVENTION

Figure 1:
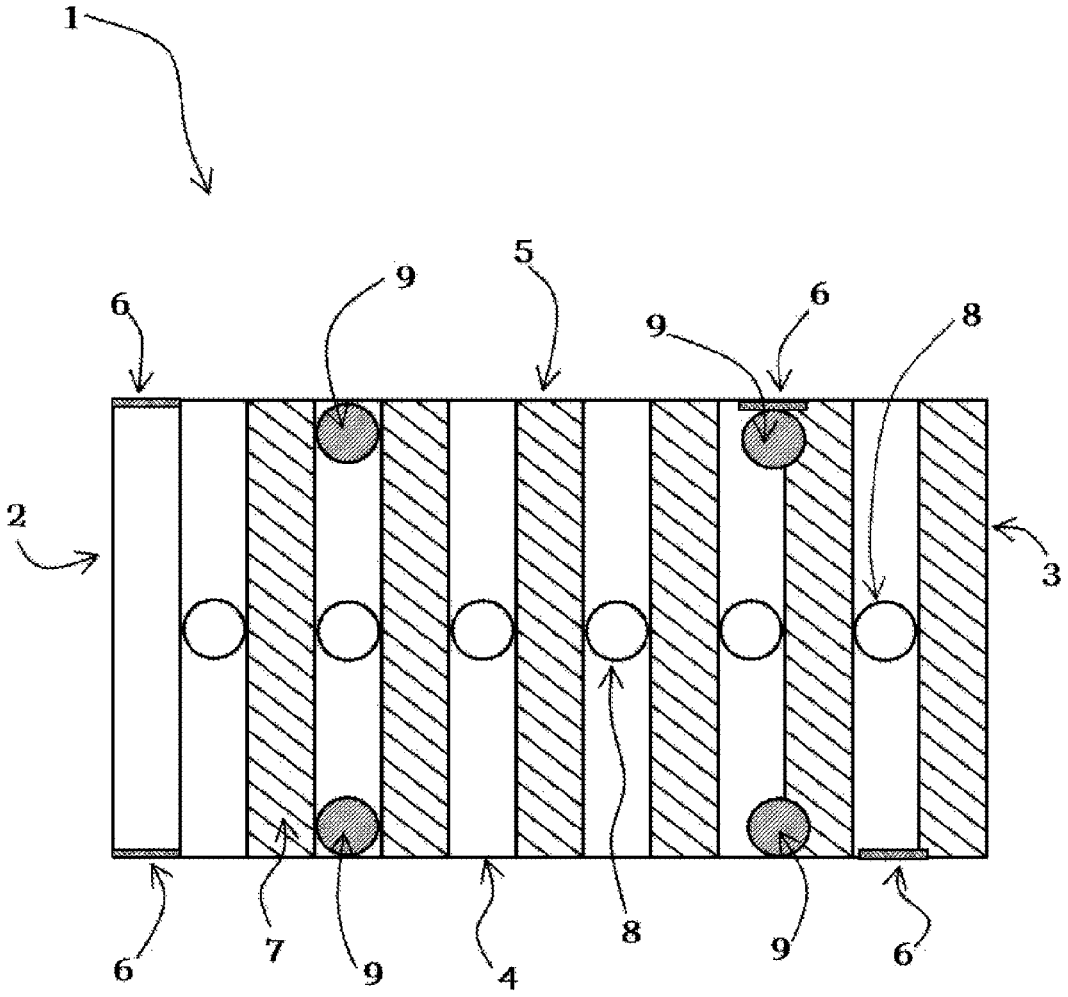
FIG. 1 illustrates schematic representation of preferred embodiments of the present invention.

Human safety requires that vehicle body should be made in such a manner that explosions outside the vehicle, whether under the vehicle, under the wheels of vehicle and/or on sides of the vehicle, neither topples the vehicle nor damages the vehicle, nor causes harm to personnel/occupants and materials/equipments therein, and at the same time the improvements provided to meet these requirements does not adversely effect its operational efficiency and maneuvering so that the vehicle produced is capable of solving above-described problems, and overcoming above-described drawbacks and limitations of the prior art, and satisfying above-described objects of the present invention.

With aim to produce such a vehicle, the inventors have surprisingly observed that if blast air force and energy can be directed through a passage in such a manner that it passes from side of the explosion/blast to another side of the vehicle, then not only toppling of vehicle and damage to vehicle can be avoided, but also injury and harm to the personnel/occupants and materials/equipments therein can be avoided, and at the same time, operational efficiency and maneuvering of the vehicle will not be adversely effected because the system provided only aims to dissipate the blast air force and energy by directing it from side of the explosion/blast to another side of the vehicle, and therefore, the vehicle produced will be capable of solving above-described problems, and overcoming above-described drawbacks and limitations of the prior art, and satisfying above-described objects of the present invention.

The inventors have also surprisingly observed that if flying metallic debris caused due to explosion of a projectile be deviated before hitting the walls of the vehicle by providing a specially designed sheet armor around the walls of the vehicle then any possible damage to the vehicle, and to the personnel/occupants and materials/equipments in the vehicle can also be avoided.

The specially designed components of the prior art, like sheet armor, plate liner, floor plate, bottom plate, foot floor, flexible connecting elements, air spring bags, bottom portion, metallic energy absorbing member may be able to withstand blasts of certain intensity, as these may be made of varying strength so as to be strong enough to withstand the disruptive force of the explosion. However, none of these components are capable of acting as blast air force and energy dissipating mechanism by directing the blast air force and energy through a path from side of explosion to another side of the vehicle.

Therefore, the present invention relates to a vehicle comprising a body having front, rear, left, right, top and bottom sides, provided with one or more doors and seating arrangements being capable of dissipating explosion force and energy, both passively and actively, caused due to explosion outside the vehicle including under the vehicle, below the wheels and on side of the vehicle, without causing toppling and damage to the vehicle, and simultaneously providing safety and stability to the personnel and material therein, and without adversely effecting its operational efficiency and maneuvering, wherein blast air force and energy is directed through one or more passages running from one side of the vehicle to opposite side of the vehicle in a manner that blast air force and energy generated on explosion dissipates from side of the explosion through said passages to another side of the vehicle.

In one embodiment, the present invention relates to a vehicle capable of deviating flying metallic debris caused due to explosion of a projectile before these hit walls of the vehicle so as to avoid any possible damage to the vehicle, and to the personnel/occupants and materials/equipments in the vehicle.

A vehicle generally comprises a body having front, rear, left, right, top and bottom sides, wherein one or more doors are provided for entry and exit, and seating arrangement is provided inside the vehicle for driver and passengers/personnel/occupants, and provisions for placing luggage of the passengers/personnel/occupants, or for transportable materials are provided, and an engine and driving mechanism is placed at an appropriate point of the vehicle. It may be noted that present invention is neither restricted by any of such provisions of the vehicle nor by purpose of the vehicle for which it is to be used and nor by its design and constructional features. It has been observed that present invention is applicable to any type of vehicle.

Accordingly, the present invention relates to a vehicle [FIG. 1] comprising a body 1 having front 2, rear 3, left 4, right 5, top and bottom sides [not shown], provided with one or more doors 6 and seating arrangements with provisions for movement [not shown], wherein blast air force and energy is directed through one or more hollow structures 7, 8, 9 running from one side of the vehicle to opposite side of the vehicle in a manner that blast air force and energy generated on explosion dissipates or travels from side of the explosion through hollow structures to another side of the vehicle.

In accordance with one of the preferred embodiments of the present invention, the hollow structures 7 are provided in such a manner that these run horizontally from one side [left side] of the vehicle to another side [right side] of the vehicle, and are capable of allowing the blast air force and energy, generated on explosion of the explosive on side of the vehicle, to travel from side of the explosion to another side of the vehicle, and thereby the blast air force and energy surprisingly gets dissipated without causing any toppling of vehicle and damage to vehicle, and any injury and harm to personnel/occupants and materials/equipments therein, and any stress to vehicle's body metal sheet.

In accordance with another preferred embodiment of the present invention, the hollow structures 8 are provided in such a manner that these run vertically from bottom side of the vehicle to top side of the vehicle, and are capable of allowing the blast air force and energy, generated on explosion of the explosive under the vehicle, to travel from underside of the vehicle to top side of the vehicle, and thereby the blast air force and energy surprisingly gets dissipated without causing any toppling of vehicle and damage to vehicle, and any injury and harm to personnel/occupants and materials/equipments therein, and any stress to vehicle's body metal sheet.

In accordance with still another preferred embodiment of the present invention, the hollow structures 9 are provided in such a manner that these run vertically just above the wheel structures from bottom side of the vehicle to top side of the vehicle, and are capable of allowing the blast air force and energy when generated on explosion of the explosive under the wheels of the vehicle, to travel from underside of the vehicle to top side of the vehicle, and thereby the blast air force and energy surprisingly gets dissipated without causing any toppling of vehicle and damage to vehicle, and any injury and harm to personnel/occupants and materials/equipments therein, and any stress to vehicle's body metal sheet.

Figure 2A:
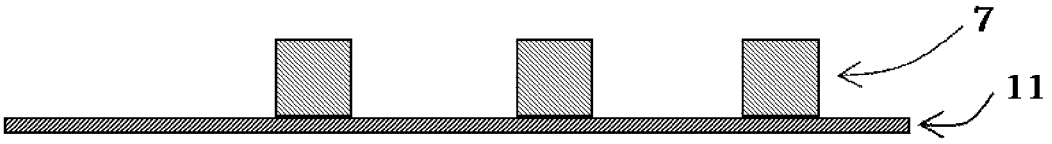
FIG. 2A illustrates that hollow structures 7 running horizontally from one side of the vehicle to another side of the vehicle are provided above the base structure 11 of the vehicle in accordance with one of preferred embodiments of the present invention.

In accordance with one of preferred embodiments of the present invention, the hollow structures 7 running horizontally from one side [left side] of the vehicle to another side [right side] of the vehicle may be provided above the base structure 11 of the vehicle [FIG. 2A] and may serve dual purpose of acting as hollow boxes of the seating arrangements.

Figure 2B:
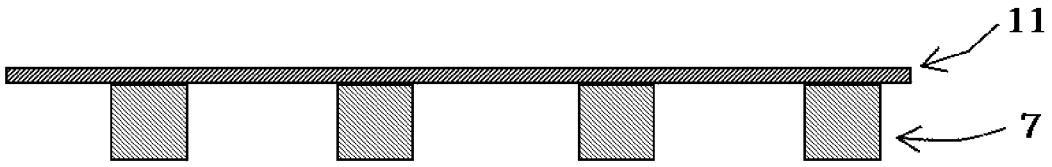
FIG. 2B illustrates that hollow structures 7 running horizontally from one side of the vehicle to another side of the vehicle are provided below the base structure 11 of the vehicle in accordance with one of preferred embodiments of the present invention.

In accordance with one of preferred embodiments of the present invention, the hollow structures 7 running horizontally from one side [left side] of the vehicle to another side [right side] of the vehicle may be provided below the base structure 11 of the vehicle [FIG. 2B] and may serve dual purpose of providing additional strength to the base structure of the vehicle.

Figure 2C:
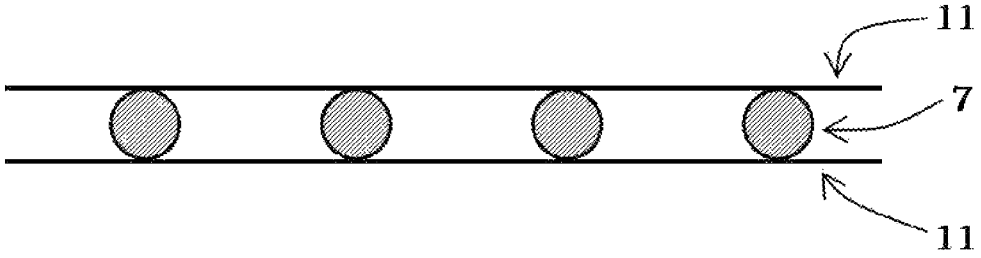
FIG. 2C illustrates that hollow structures 7 running horizontally from one side of the vehicle to another side of the vehicle are provided within the base structure 11 of the vehicle in accordance with one of preferred embodiments of the present invention.

In accordance with one of preferred embodiments of the present invention, the hollow structures 7 running horizontally from one side [left side] of the vehicle to another side [right side] of the vehicle may be provided within the base structure 11 of the vehicle [FIG. 2C] and may serve dual purpose of providing additional strength to the base structure of the vehicle.

Figure 3A:
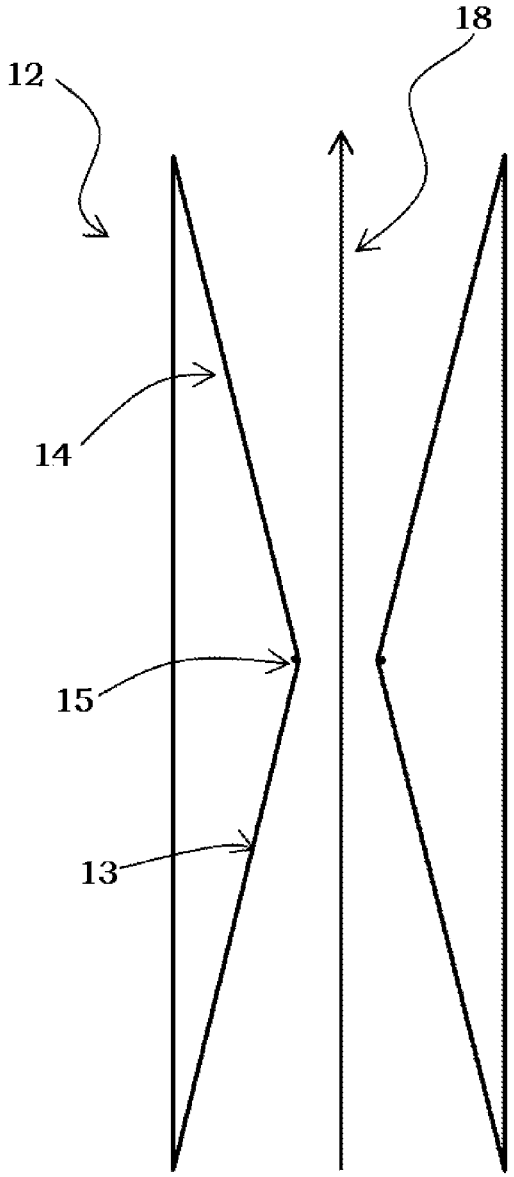
FIG. 3A illustrates a conical structure 12 in accordance with one of preferred embodiments of the present invention comprising lower part of upwardly converging cone 13 and upper part of upwardly diverging cone 14 which join together at a point 15 in such a manner that these form a structure which may also be referred to as biconical structure.
Figure 3B:
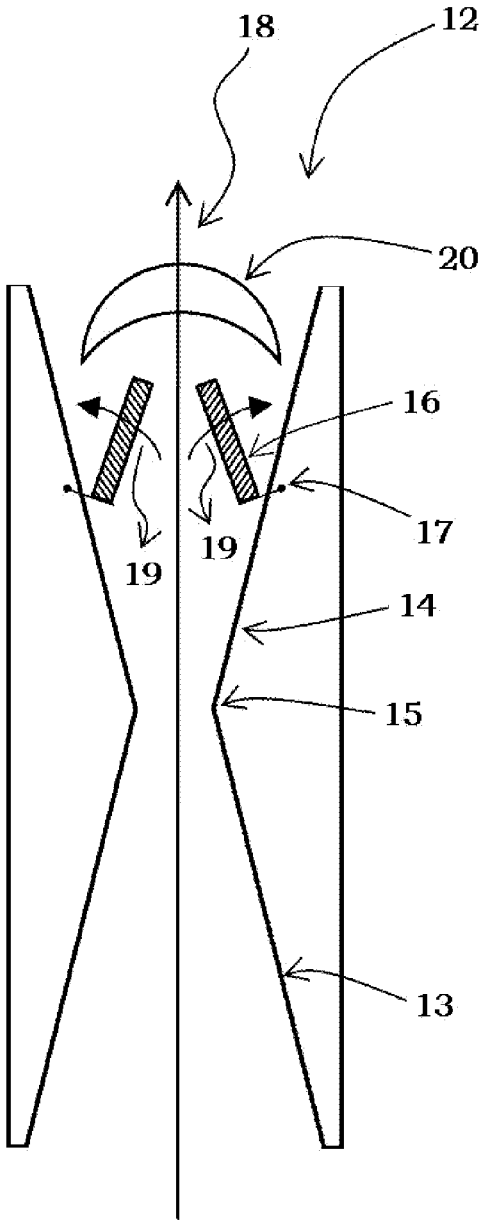
FIG. 3B also illustrates a conical structure 12 in accordance with one of preferred embodiments of the present invention comprising lower part of upwardly converging cone 13 and upper part of upwardly diverging cone 14 which join together at a point 15 in such a manner that these form a structure which may also be referred to as biconical structure, and the biconical structures 12 are provided with one or more angulated explosives 16 which are fixed in upper part 17 of the upwardly diverging cone 14 in such a manner that upon flow of blast air force and energy in direction of arrow 18 these get exploded and divert in direction of arrows 19, cause a downward force on the biconical structure 12 due to forceful emission of gases in upward direction forming a zone 20 in upper part of the biconical structure 12.

In accordance with one of preferred embodiments of the present invention, the hollow structures 8 and 9 running vertically from bottom side of the vehicle to top side of the vehicle comprises a conical structure 12 [FIG. 3A and FIG. 3B] comprising lower part of upwardly converging cone 13 and upper part of upwardly diverging cone 14 which join together at a point 15 in such a manner that these form a structure which may also be referred to as biconical structure and is as illustrated in accompanying FIG. 3A which has been surprisingly found to generate reverse thrust on the blast air force and energy so as to cause its immediate passing-through from side of explosion to opposite side of the hollow structures. These structures have been found to be capable of actively nullifying the blast energy by creating a suction effect actively. Further, these structures may also serve dual purpose of providing additional strength to body of the vehicle.

In accordance with one of preferred embodiments of the present invention, the biconical structures 12 are provided with one or more angulated explosives 16 which are capable of being triggered on contact with blast air force and energy.

In accordance with one of the preferred embodiments of present invention, the angulated explosives 16 are fixed in upper part 17 of the upwardly diverging cone 14 in such a manner that upon flow of blast air force and energy in direction of arrow 18 these get exploded and divert in direction of arrows 19.

A downward force on the biconical structure 12 is surprisingly observed when angulated explosives 16 explode upon contact with blast air force and energy generated by explosion of explosives on opposite side [side opposite to the end provided with angulated explosives 16] of the biconical structure 12. This downward force may be caused due to forceful emission of gases in upward direction forming a zone 20 in upper part of the biconical structure 12.

In accordance with one of the preferred embodiments of present invention, the passage or hollow structure 8, 9 is provided with a sensing means [not shown in accompanying figures] to sense gas pressure, heat and acceleration which senses beginning of blast under the wheel of the vehicle or under the vehicle. In accordance with one of the preferred embodiments of the present invention, the sensing means are electromagnetic sensing means, which upon sensing the blast immediately generate an electrical spark to trigger angulated explosives 16.

It is observed that gas emerging from the angulated explosives 16 sucks up the blast air and possibly forms a zone 20, which has been found to further enhance the sucking out of the blast air.

Accordingly, in accordance with present invention, the biconical structures 12 are capable of enhancing sucking out of blast air, which is further enhanced on explosion/triggering of angulated explosives 16, and thereby, the blast air force and energy are dissipated immediately, and therefore, the stability of vehicle is not adversely affected.

In accordance of one of the preferred embodiments of the present invention, tyres of vehicle may be made solid with interconnected channels which has been found to avoid breaking up of the tyre material on account of blast energy.

The stability obtained on employing system of present invention helps the driver to maintain control even if blast is right under a wheel.

The stability of vehicle is additionally enhanced due to downward force generated by angulated explosive and forcefully emerging gases therefrom.

As at the time of explosion stability of the vehicle is enhanced, the toppling of the vehicle and damage to the vehicle is substantially avoided.

In accordance with one of the preferred embodiments, the angulated explosives can be easily fitted by driver of the vehicle so that he need not to take the vehicle for servicing and re-fixing of angulated explosives when these have been exhausted upon a blast.

Therefore, in accordance with present invention, if there is an explosion on a side of the vehicle the blast air force and energy will travel through the hollow structures from side of explosion to other side of the vehicle and surprisingly gets dissipated without causing any toppling of vehicle and damage to vehicle, and any injury and harm to personnel/occupants and materials/equipments therein, and any stress to vehicle's body metal sheet.

Presently, mechanism for above surprising effect is not known, however, it is believed that immediate travel of blast air force and energy through the hollow structures of present invention is responsible for such unexpected advantages.

It is also believed that wheels on side opposite to the blast if blast takes place on side of the vehicle acts as a pivot, and thereby, avoids toppling of and damage to vehicle.

As improvement in the vehicle, in accordance with present invention, comprises providing hollow structures, it surprisingly does not adversely affect operational efficiency and maneuvering of the vehicle. Therefore, the vehicle produced in accordance with present invention will remain capable of climbing up the hills, and will be less prone to attack.

Further, as the hollow structures provided in accordance with present invention can be made from ordinary sheet material, it surprisingly saves on cost of manufacturing of the vehicle. Therefore, the vehicle produced in accordance with present invention will not be expensive and unaffordable.

In accordance with one of the preferred embodiments of the present invention, a net-type covering means which is capable of allowing flow of blast air, but preventing entry of an explosive and its fragments in the hollow structures is provided on openings of the hollow structures so that entry of the explosive into hollow structure is avoided, which, if entered may explode under the seat.

In accordance with one of the preferred embodiments of the present invention, outside of net-type covering means is provided with a thin metallic sheet which is capable of rupturing on contact with blast air force and energy and camouflages the net-type covering means in such a manner that location of hollow structures is not discernible from the outside.

The blast can take place at any point or at any angle of the vehicle. In case blast takes place near or at the glass window of the vehicle, the arrangement described herein above cannot protect damage to the vehicle and injury to the occupants and material therein. To overcome this problem the glass window cannot be removed, because the personnel sitting inside the vehicle would desire to see outside. However, this poses a greater risk to the personnel and to the vehicle, because any explosion near or at the window will cause shattering and tremendous injury to the passengers.

The present invention also provides a solution to above problem by employing same inventive feature as above, that is, by directing the blast air force and energy, caused due to blast near or at the glass window, through a hollow structure provided above glass window area.

In accordance with this embodiment, a periscope like arrangement 21 is provided on sidewalls of the vehicle and near seating arrangement for the passengers in such a manner that passengers keep seeing outside the vehicle so that their comfort is not compromised.

Figure 4:
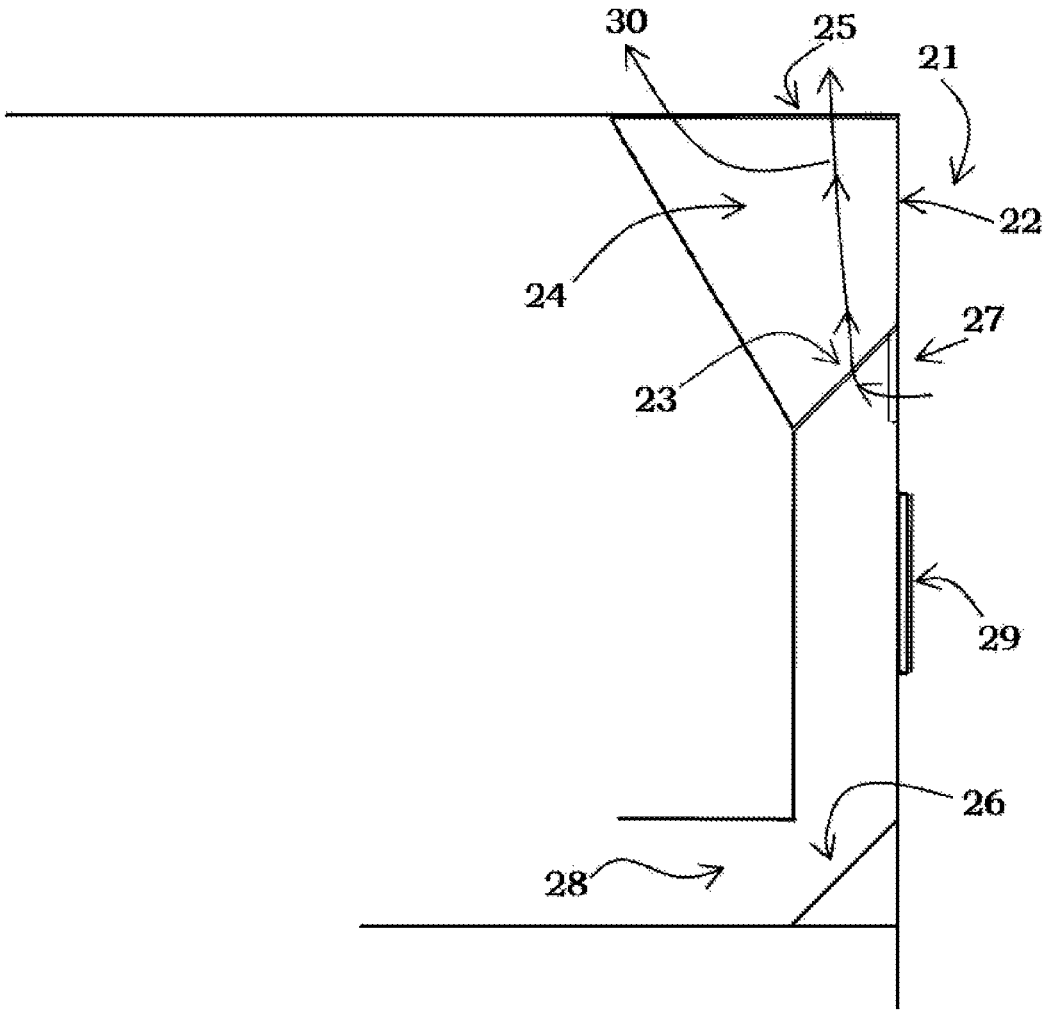
FIG. 4 illustrates schematic representation of yet another preferred embodiment of the present invention and its manner of dissipating blast air force and energy in accordance with present invention.

In accordance with present invention, the periscope like structure 21 [FIG. 4] is provided with an extension chamber 22 continuing from upper side mirror 23 of the periscope like structure 21 towards top side of the vehicle while forming a hollow structure 24, wherein top end of extension chamber 22 is provided with rupturable closing means 25 which is capable of rupturing on contact with blast air force and energy.

In accordance with present invention, upper side mirror 23 of the periscope like structure 21 is breakable and lower side mirror 26 is unbreakable, and upper opening 27 is provided with another breakable glass and lower opening 28 is normal opening allowing the passenger to keep viewing outside the vehicle. The normal window place is provided with a metallic sheet 29 which looks like glass window.

In accordance with one of the preferred embodiments of the present invention, lower side mirror 26 is backed with metal sheet.

In accordance with preferred embodiment of the present invention, the light enters the periscope 21 through opening 27 which on reflection through mirrors 23 and 26 passes through opening 28 to provide the passenger outside view.

In accordance with preferred embodiment of the present invention, when a blast takes place near or at the window, glass provided at opening 27 and mirror 23 breaks down and direct the blast air force and energy through hollow structure 24, which immediately breaks rupturable closing means 25, and thereby causes blast air force and energy to dissipate through top end 25 of the periscope like structure 21 via a path shown by arrow 30, and hence, nullifying its effect without causing any shattering and damage to the vehicle and passengers sitting inside the vehicle. As glass 27 is well above head level of the sitting passenger, the blast air force and energy does not cause any damage to the passenger.

The configuration provided by present invention has been found to be capable of dissipating the blast air force and energy caused due to blast near or at the glass window by directing the blast air force and energy through the hollow structure 24 which surprisingly move out from the side of blast through hollow structure 24 and get dissipated from top side of the vehicle without causing any stress to vehicle body, body material and occupants and materials therein and actively nullifying the blast energy by creating a suction effect actively.

The blast may also take place at a point or at an angle of the vehicle, which may be so located that blast air force and energy may not get directed through the hollow structures provided in accordance with present invention and thereby may cause some damage to vehicle and injury to passengers therein. The present invention also provides a solution to this problem by employing same inventive feature as above, that is, by directing and dissipating the blast air force and energy and as well flying debris and shrapnels caused due to blast through a hollow structure provided around walls of the vehicle.

In accordance with preferred embodiment of the present invention, the walls of the vehicle and seats provided for passengers may be made of corrugated sheet of present invention, or may be provided with extra covering of corrugated sheet of present invention.

Figure 5:
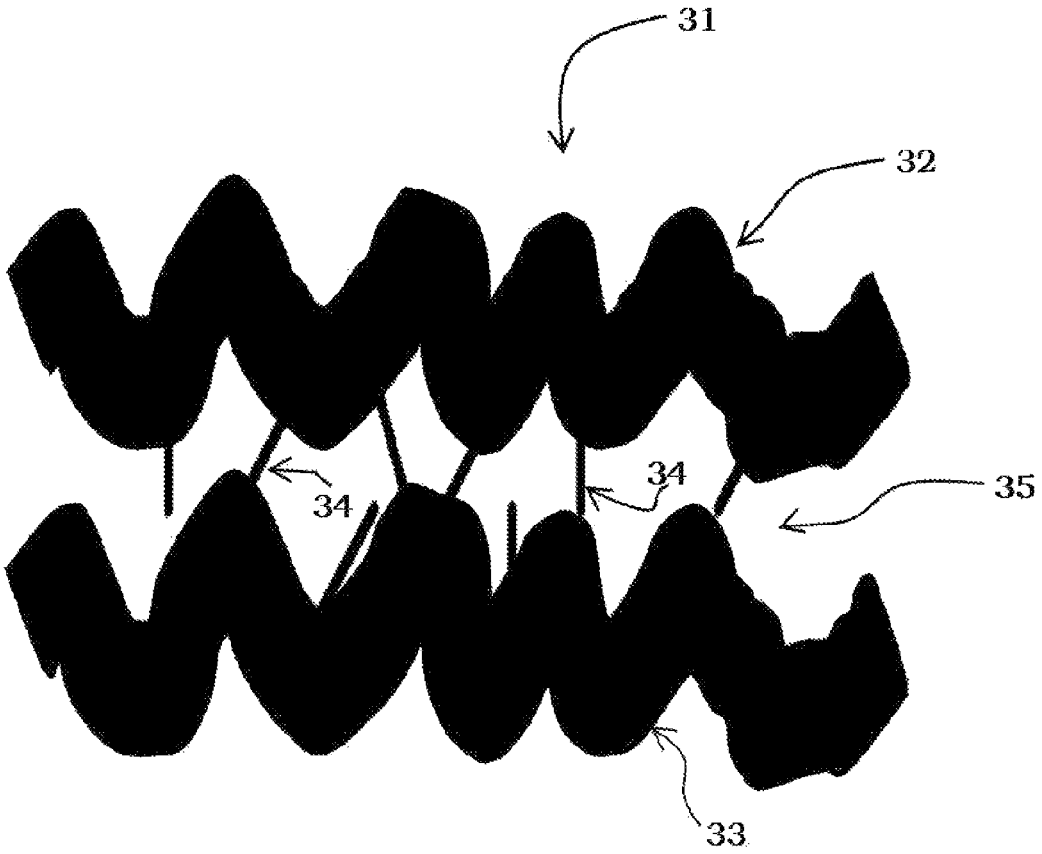
FIG. 5 illustrates schematic representation of further preferred embodiment of the present invention and its manner of dissipating blast air force and energy and flying debris in accordance with present invention.

In accordance with present invention, the corrugated sheet 31 [FIG. 5] consists of a sandwich structure comprising two corrugated sheets 32 and 33 provided therebetween with metallic micro baffles 34 placed in random orientations and the sheets 32 and 33 are arranged in such a manner that these form a gap 35 therebetween.

In accordance with present invention, some of the baffles extend only partly from one corrugated sheet layer to the proximity of the opposite layer but the extend in the longitudinal direction is linger enough. Other baffles are short in length and extend from one corrugated sheet to opposite sheet. The first set of baffles divert a shrapnel entering through one layer of corrugation into multiple paths thereby dissipating the energy of the shrapnel and preventing penetration of the shrapnel in the inner corrugated sheet. The other set of baffles which are short in length but extend from one layer to the other also divert shrapnel. Additionally the link between the outer and inner corrugated layers augments the structural strength.

The sheet 31 of present invention has been found to be capable of providing strength as well as deformable to absorb impact energy.

In accordance with present invention, the corrugations are in a mix of radial and circular forms. In case of a blast air will pass through the layers and hit the micro baffles and lose energy as well as get directed in different directions so that forces tend to null. The corrugation will extend and the bending will absorb energy without shattering. Thus, protection is obtained with total mass of sheet metal much less than that which has been used in case of thick sheet armor.

As sheet armor provided by present invention is not a rigid structure, it has been surprisingly found to be capable of stopping and diverting flying debris and shrapnels from entering or hitting the walls of vehicle, and if by-chance some of the flying debris and shrapnels enter the sheet armor of present invention, their energy effect gets dissipated due to micro baffles and within the gap formed by two corrugated sheets of the sheet armor, and thereby possibility of any damage to vehicle and injury to passengers is avoided.

Accordingly, it is understood that present invention has provided a solution to existing problems of toppling of and damage to vehicle, and of injury to the personnel and damage of internal material therein on blast outside the vehicle, whether under the vehicle, below the wheels, and/or on side of the vehicle, by providing a system for the vehicle which renders the vehicle stable and capable of dissipating explosion force and energy [blast air force and energy] caused due to blast at or around any point or angle outside the vehicle.

What is claimed is:

1. A vehicle comprising a body 1 having front 2, rear 3, left 4, right 5, top and bottom sides, provided with one or more doors 6 and seating arrangements to dissipate explosion force and energy, caused due to explosion outside the vehicle including under the vehicle, below the wheels and on side of the vehicle, without causing toppling and damage to the vehicle, and simultaneously providing safety and stability to the personnel and material therein, and without adversely effecting its operational efficiency and maneuvering, wherein blast air force and energy is directed through one or more passages 7, 8, and 9 running from one side of the vehicle to opposite side of the vehicle in a manner that blast air force and energy generated on explosion dissipates from side of the explosion through said passages 7, 8, and 9 to another side of the vehicle, wherein said one or more passages 7 are provided at one of the positions selected from above, below and within the base structure 11 of the vehicle in a manner that these run horizontally from one side of the vehicle to another side of the vehicle, said one or more passages 8 are provided in a manner that these run vertically from bottom side of the vehicle to top side of the vehicle, and said one or more passages 9 are provided in a manner that these run vertically just above the wheel structures from bottom side of the vehicle to top side of the vehicle;

said passages 7, 8, 9 are provided with a net-type covering means;

said net-type covering means is provided on the openings of said passages 7, 8, 9;

said net-type covering means allows flow of blast air, but prevent entry of the explosive and its fragments and shrapnels;

the net-type covering means is provided with a thin metallic sheet to camouflage said net-type covering means; and the thin metallic sheet ruptures on contact with blast air force and energy.

2. A vehicle as claimed in claim 1, wherein said one or more passages 7 running horizontally from one side of the vehicle to another side of the vehicle allow blast air force and energy, generated on explosion on one side of the vehicle, to dissipate from side of explosion to another side of the vehicle.

3. A vehicle as claimed in claim 1, wherein said one or more passages 8 running vertically from bottom side of the vehicle to top side of the vehicle allow blast air force and energy, generated on explosion under the vehicle, to dissipate from underside of the vehicle to top side of the vehicle.

4. A vehicle as claimed in claim 1, wherein said one or more passages 9 running vertically just above the wheel structures from bottom side of the vehicle to top side of the vehicle allow blast air force and energy, generated on explosion under the wheels of the vehicle, to dissipate from underside of the vehicle to top side of the vehicle.

5. A vehicle as claimed in claim 1, wherein said one or more passages 8 and 9 comprise a conical structure 12 comprising lower part of upwardly converging cone 13 and upper part of upwardly diverging cone 14 joining together at a point 15 in a manner that these form a biconical type structure to generate reverse thrust on the blast air force and energy.

6. A vehicle as claimed in claim 5, wherein said biconical type structures 12 are provided with one or more angulated explosives 16, trigger on contact with blast air force and energy.

7. A vehicle as claimed in claim 6, wherein said angulated explosives 16 are provided in upper part 17 of upwardly diverging cone 14.

8. A vehicle as claimed in claim 7, wherein a downward force is caused due to forceful emission of gases in upward direction forming a zone 20 in upper part of said biconical type structure 12.

9. A vehicle as claimed in claim 5, wherein said passage 8, 9 is provided with a sensing means to sense gas pressure, heat and acceleration which senses beginning of blast under the wheel of the vehicle or under the vehicle.

10. A vehicle as claimed in claim 9, wherein said sensing means is an electromagnetic sensing means, which generates an electrical spark to trigger angulated explosives 16.

11. A vehicle as claimed in claim 1, wherein said vehicle is provide with solid tires comprising interconnected channels.

12. A vehicle as claimed in claim 1, wherein said vehicle further comprises a periscopic hollow structure 21 provided above glass window area or on sidewalls of the vehicle and near seating arrangement, wherein said periscope 21 is provided with an extension chamber 22 continuing from its upper side mirror 23 towards top side of the vehicle and forming a hollow structure 24, and wherein top end of said extension chamber 22 is provided with rupturable closing means 25.

13. A vehicle as claimed in claim 12, wherein upper side mirror 23 of periscope 21 is breakable and lower side mirror 26 is unbreakable, and wherein upper opening 27 of said periscope 21 is provided with breakable glass and lower opening 28 is normal opening allowing the passenger to keep viewing outside the vehicle.

14. A vehicle as claimed in claim 1, wherein said vehicle further comprises a metallic sheet 29, which gives look of a glass window.

15. A vehicle as claimed in claim 1, wherein walls of said vehicle are made of corrugated sheet 31, or are provided with extra covering of corrugated sheet 31, and seats provided for passengers in said vehicle are made of corrugated sheet 31.

16. A vehicle as claimed in claim 15, wherein said corrugated sheet 31 consists of a sandwich structure comprising two corrugated sheets 32 and 33 provided therebetween with metallic micro baffles 34 placed in random orientations.

17. A vehicle as claimed in claim 16, wherein said sheets 32 and 33 are arranged to form a gap 35 therebetween.

18. A vehicle as claimed in claim 16, wherein some of the baffles 34 are short in length and extend from one corrugated sheet to opposite sheet.

* * * * *